US006989501B2

(12) United States Patent
Carrara

(10) Patent No.: US 6,989,501 B2
(45) Date of Patent: Jan. 24, 2006

(54) CURRENT LIMITING CIRCUIT BREAKER

(75) Inventor: Osvaldo Carrara, Casnigo (IT)

(73) Assignee: ABB Services S.R.L., Milan (IT)

( * ) Notice: Subject to any disclaimer, the term of this patent is extended or adjusted under 35 U.S.C. 154(b) by 103 days.

(21) Appl. No.: 10/451,540

(22) PCT Filed: Dec. 11, 2001

(86) PCT No.: PCT/EP01/14695

§ 371 (c)(1),
(2), (4) Date: Nov. 6, 2003

(87) PCT Pub. No.: WO02/052597

PCT Pub. Date: Jul. 4, 2002

(65) Prior Publication Data

US 2004/0069604 A1 Apr. 15, 2004

(30) Foreign Application Priority Data

Dec. 27, 2000 (IT) ..... MI2000A2834

(51) Int. Cl.
*H01H 5/00* (2006.01)

(52) U.S. Cl. ..... 200/400; 200/47; 335/16; 335/76

(58) Field of Classification Search ..... 200/400–401, 200/47, 48 R–48 P, 238; 335/8–16, 76, 147, 335/167, 195, 202
See application file for complete search history.

(56) References Cited

U.S. PATENT DOCUMENTS 4,600,908 A * 7/1986 Uchida et al. ..... 335/8
4,644,120 A 2/1987 Tedesco
4,843,359 A * 6/1989 Morris et al. ..... 335/6
5,146,194 A * 9/1992 Altenhof et al. ..... 335/16
5,264,673 A * 11/1993 Powell ..... 200/401
5,539,167 A * 7/1996 Hood et al. ..... 200/244
5,579,901 A * 12/1996 Faber et al. ..... 200/401
5,651,451 A * 7/1997 Castonguay et al. ..... 200/400
5,844,455 A * 12/1998 Song ..... 335/16
5,874,699 A * 2/1999 Beck et al. ..... 200/244

FOREIGN PATENT DOCUMENTS

EP 0 619 593 A 10/1994

* cited by examiner

*Primary Examiner*—Richard K. Lee
(74) *Attorney, Agent, or Firm*—Connolly Bove Lodge & Hutz LLP; Larry J. Hume

(57) ABSTRACT

A multipole current limiting circuit breaker comprising an insulating enclosure that contains: a) for each pole, at least one fixed contact and at least one movable contact, which can be mutually coupled/uncoupled upon closure/opening of the circuit breaker; b) actuation means which provide the energy for moving said movable contacts and determines their coupling/uncoupling with the corresponding fixed contacts, said actuation means comprising a rotating actuation bar that is operatively coupled to the movable contacts of the poles; characterized in that said movable contacts have a fork-shaped body having a base element that supports two arms provided with plates for electrical contact with corresponding coupling surfaces of the fixed contact, and in that said fork-like body is connected to the actuation bar by virtue of elastic means accommodated at least partially in a seat formed in the bar, said elastic means being anchored to said bar and being fixed to said base element so as to support the movable contact and facilitate a substantially uniform distribution of the pressure applied by the contact plates to said corresponding coupling surfaces of the fixed contact.

20 Claims, 2 Drawing Sheets

CURRENT LIMITING CIRCUIT BREAKER

The present invention relates to a multipole low-voltage current limiting circuit breaker of the type with fork-like movable contacts; more specifically, the expression "low-voltage circuit breaker" is to be understood as designating a circuit breaker for applications with operating voltages up to approximately 1000 volts.

Generally, low-voltage industrial electrical systems in which high-value currents and therefore high power levels are involved normally use specific devices, commonly known in the art as automatic or power circuit breakers.

Such circuit breakers typically operate with currents whose nominal value, depending on the applications, can vary over a wide range, typically from fractions of an ampere to several thousand amperes, and are meant to provide a series of performances that are required in order to ensure the correct operation of the electrical system in which they are inserted and of the loads connected thereto. For example, they protect the loads from abnormal events caused by short-circuit faults or due to overloads by automatically opening the power supply circuit, they allow the correct insertion/disconnection of loads in/from the circuit, they ensure that the nominal current for the various connected users is truly equal to the required current, et cetera.

Currently, these circuit breakers are available according to various constructive solutions; in the most common and widely used of these solutions, in the standard basic configuration, the maneuvers for uncoupling/coupling the fixed contacts and the movable contacts are performed by using complex mechanisms that utilize the mechanical energy accumulated beforehand in special opening springs to actuate the movable contacts and move them at an adequate speed.

In certain operating conditions, particularly when the presumed short-circuit current can assume significantly high values, the use of automatic circuit breakers in the base version is not entirely satisfactory, since the energy accumulated by the opening springs alone can be insufficient to ensure separation of the contacts with an adequate opening speed.

In these situations, one therefore uses specific automatic circuit breakers, which are known in the art as limiting circuit breakers, which are provided with appropriate technical solutions suitable to increase their breaking capacity.

In particular, a first technical solution imposes to the current a given path so that electrodynamic repelling forces are generated between the contacts when a short circuit occurs. These repelling forces generate a thrust that is useful for the separation of the movable contacts from the fixed contacts, and therefore help to reach an adequate opening speed.

In a second technical solution, for each pole of the circuit breaker the fixed contacts and the movable contacts are doubled so that the flow of electric current is interrupted in two separate regions of the pole arranged electrically in series to each other.

These two solutions, which are generally used in mutual association but can also be used individually, allow an improved performance particularly as regards the breaking capacity of the circuit breakers. Nevertheless, known types of limiting circuit breakers, despite ensuring a satisfactory functional performance, have drawbacks and disadvantages.

In particular, a critical aspect in the case of circuit breakers with doubled contacts consists of the need to have, for each pole, a mechanical pressure that is equally distributed on the two coupling surfaces between each fixed contact and the corresponding movable contact. When this condition is not met, there are in fact negative effects on electrical conductivity, which degrades continuously over the useful lifetime of the circuit breaker due to the progressive, irregular and asymmetric wear of the conducting plates arranged on the coupling surfaces of the contacts.

In order to obviate these drawbacks, the structure that supports the movable contacts and connects them to the switchgear, which is generally constituted by a rotating bar or shaft, is conceived so as to have degrees of freedom with respect to said actuation element and therefore also with respect to the fixed contacts. In particular, in the case of double movable contacts of the fork-like type, the body of the contact is provided with a small shaft that is articulately connected to the switchgear. Additional springs, generally in pairs, are furthermore associated with the structure of each movable contact and, by utilizing the freedom of motion of the movable contact with respect to the fixed contact and with respect to the switchgear, facilitate the self-adaptation of the movable contact surfaces with respect to the fixed ones and the uniform distribution of contact pressure.

However, said additional springs, in addition to increasing the complexity of the general mechanism of the movable contacts and affecting costs, apply undesirable flexural and compression stresses to the support of the movable contacts and more specifically to their shaft; these stresses, also in view of the large number of maneuvers that the circuit breaker is required to perform during its useful lifetime, cause a gradual increase in the friction that opposes the movement of the structure of each movable contact with respect to the actuation bar, and cancels out or in any case reduces the benefits offered by the freedoms of movement of the structure of the movable contact. Furthermore, said stresses cause the gradual plastic deformation of the shafts and even the seizure of the entire mechanism.

The aim of the present invention is to provide a multipole current limiting circuit breaker that allows to obviate the drawbacks of the prior art and in particular has a simplified structure and an improved functional performance with respect to known types of limiting circuit breaker.

Within this aim, an object of the present invention is to provide a multipole current limiting circuit breaker in which the structure of the movable contacts and their connection to the switchgear allows to improve the distribution of mechanical stresses and to eliminate friction, eliminating or at least minimizing the possibility of seizures.

Another object of the present invention is to provide a multipole current limiting circuit breaker that allows to optimize the distribution of the contact pressure among the movable and fixed contacts of each pole.

Another object of the present invention is to provide a multipole current limiting circuit breaker that has a smaller number of constructive components than known circuit breakers and whose assembly is simplified.

Another object of the present invention is to provide a multipole current limiting circuit breaker that is highly reliable, relatively easy to provide and at competitive costs.

This aim and these and other objects that will become better apparent hereinafter are achieved by a multipole current limiting circuit breaker comprising an insulating enclosure that contains:

- for each pole, at least one fixed contact and at least one movable contact, which can be mutually coupled/uncoupled upon closure/opening of the circuit breaker;
- actuation means, which provide the energy for moving said movable contacts and determines their coupling/uncoupling with the corresponding fixed contacts, said actuation means comprising a rotating actuation bar that is operatively coupled to the movable contacts of the poles;

characterized in that said movable contacts have a fork-shaped body having a base element that supports two arms provided with plates for electrical contact with corresponding coupling surfaces of the fixed contact, and in that said fork-like body is connected to the actuation bar by virtue of elastic means accommodated at least partially in a seat formed in the bar, said elastic means being anchored to said bar and being fixed to said base element so as to support the movable contact and facilitate a substantially uniform distribution of the pressure applied by the contact plates to said corresponding coupling surfaces of the fixed contact.

In this manner, each movable contact of the circuit breaker is connected to the actuation bar in an exclusively elastic manner, by virtue of elastic means that also acts as an element for supporting said contact. Accordingly, this allows to eliminate, with respect to the known art, the rigid supporting components, subjected to stresses and seizures, and in particular the supporting shaft, with a consequent advantage in terms of electrical functionalities, mechanical stress distribution, and constructive simplification.

Further characteristics and advantages will become better apparent from the description of a preferred but not exclusive embodiment of the circuit breaker according to the invention, illustrated only by way of non-limitative example in the accompanying drawings, wherein.

Figure 1:
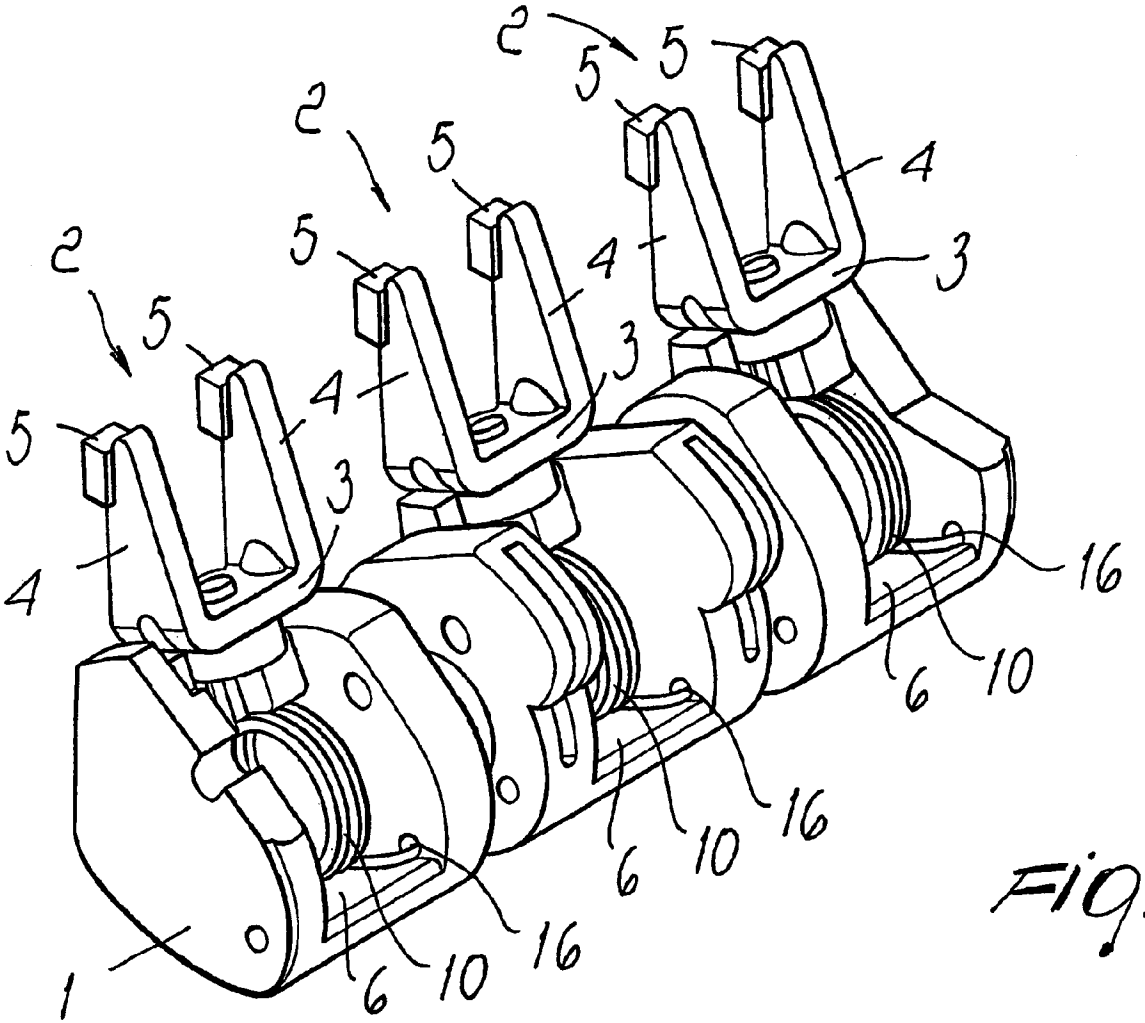
FIG. 1 is a schematic perspective view of the movable contacts, coupled to an actuation bar, of a current limiting circuit breaker according to the invention, of the three-pole type.

FIG. 1 schematically illustrates the moving equipment of a current limiting circuit breaker of the three-pole type; said limiting circuit breakers, according to solutions that are widely known in the art and are therefore not illustrated in detail, comprise, in the various versions with different numbers of poles, an insulating enclosure that contains, for each pole, at least one fixed contact and at least one movable contact, which can be mutually coupled/uncoupled upon closure/opening of the circuit breaker, at least one arc quenching chamber, an optional device for electrodynamic repulsion of the contacts upon a short-circuit condition, and actuation means, common to all the poles, that provides the energy for moving the movable contacts and cause their coupling/uncoupling with respect to the corresponding fixed contacts. In particular, said actuation means generally comprises a spring-loaded mechanism that is operatively coupled to a release device, for example of the magneto-thermal type, and to a lever for opening/closing the circuit breaker, which protrudes outside the insulating enclosure and allows manual actuation of the circuit breaker.

In particular, the spring-loaded mechanism comprises a rotating actuation bar, i.e. the contacts holding shaft, realized so as to ensure the mutual insulation of the poles, which is designated by the reference numeral 1 in FIG. 1 and is arranged in the enclosure so as to pass transversely through the various poles, and is operatively coupled to the movable contacts 2 connected thereto. In practice, when the circuit breaker opens, the spring-loaded mechanism supplies the bar 1 with the energy accumulated beforehand in the spring, by virtue of which the bar 1 turns at an adequate speed, and causes the uncoupling of the movable contacts from the fixed contacts.

In the embodiment of the limiting circuit breaker according to the invention, each movable contact 2 has a fork-like body that has a base element 3 that supports two arms 4; the two arms 4 are both provided with plates 5 for electrical contact with the corresponding coupling surfaces of the fixed contact that is complementary thereto.

Each fork-like body is connected to the actuation bar 1 by virtue of elastic means which are at least partially accommodated in a seat 6 formed in the bar 1, are anchored thereto, and are fixed to the base element 3. Preferably, in the embodiment shown in the figures, the elastic means are constituted by a coiled flexural spring 10, which is accommodated in a seat 6 formed in the bar 1 with an axis that is substantially parallel to the rotation axis of said bar 1, and is anchored thereto; alternatively, the elastic means might be provided for example by virtue of a leaf spring in which one portion is anchored to the bar 1 and another portion is fixed to the base 3 of the movable contact 2, or by virtue of other appropriately configured elastic bodies, so long as they are compatible with the application.

In particular, the spring 10 comprises at least one portion 7 that is fixed to the base element 3 so as to support the movable contact 2 and facilitate a substantially uniform distribution of the pressure applied by the contact plates 5 to the corresponding coupling surfaces of the fixed contact.

Figure 2:
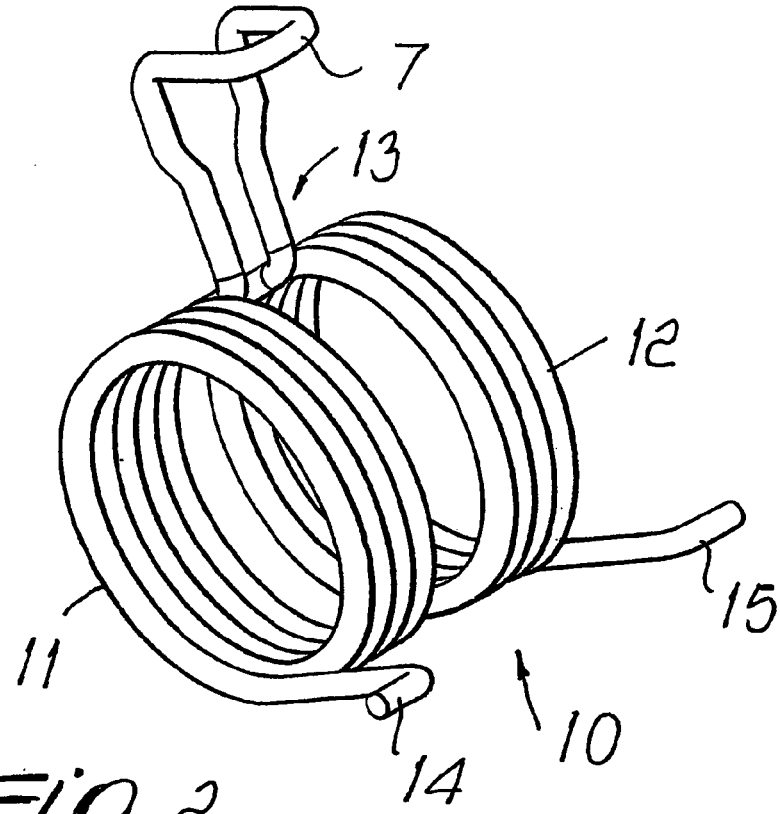
FIG. 2 is a perspective view of a coiled flexural spring used in the circuit breaker according to the invention.

In particular, as shown in detail in FIGS. 1 and 2, the coiled spring 10 comprises a first series 11 and a second series 12 of helical turns, which are arranged coaxially in the seat 6 and are substantially parallel to the rotation axis of the actuation bar 1; both said series of helical turns 11 and 12 have a free end, respectively 14 and 15, that is arranged substantially parallel to the axis of said turns and engages a corresponding recess 16 formed in the walls of the seat 6. Furthermore, the two series of turns 11 and 12 are mutually connected, in a substantially central region of said spring, by a portion of a turn 13 that lies transversely to the axis of the spring and forms the portion 7 that is fixed to the base element 3.

Figure 3:
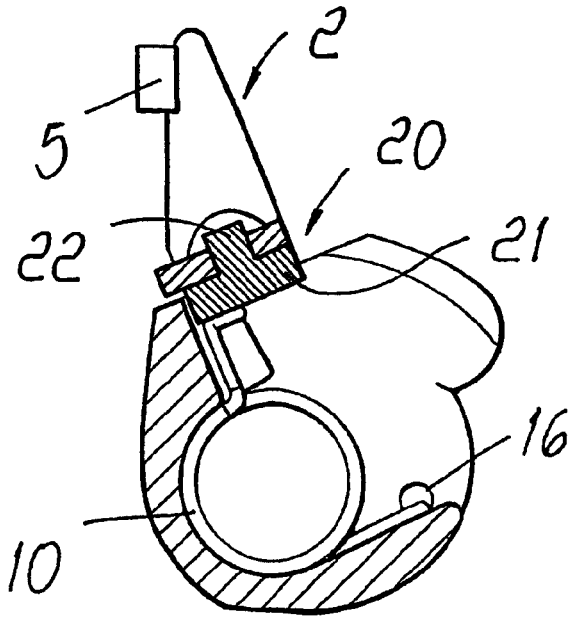
FIG. 3 is a side sectional view of FIG. 1.

As shown in detail in FIG. 3, the portion of turn 13 that lies transversely to the axis of the spring 10 comprises two substantially straight and mutually parallel arms, each connected to a corresponding series of turns; said arms are orientated in a direction that connects the actuation bar 1 to a movable contact 2 and are mutually connected by virtue of the portion 7 fixed to the base element 3. In turn, the portion 7 has a substantially U-shaped configuration.

In particular, the U-shaped portion 7 is arranged so as to rest at least partially on one face of the base element 3 and is fixed thereto by virtue of a fixing element, schematically designated by the reference numeral 20 in FIG. 3. The fixing element 20 comprises a cylindrical head 21 and a stem 22 which is also cylindrical, protrudes from the head 21 and has a smaller diameter than said head; the element 20 is rigidly fixed to the body of the movable contact 2 so that the stem 22 is surrounded by the arms of the U-shaped portion 7 and passes through the base element 3, and so that the head 20 presses the U-shaped portion 7 against a face of said base element 3. In this manner, one provides a fixing that is simple from the constructive standpoint and effective from the functional one; alternatively, the connection between the portion 7 and the body of the movable contact 3 might be provided differently, for example by using a differently configured fixing element, or by providing a direct connection between the portion 7 and the contact 2.

Advantageously, in the embodiment of the limiting circuit breaker according to the invention, the structure of the contact 2 and of the spring 10, their mutual connection, and the connection of the spring 10 to the actuation bar 1 are provided so that the first and second series of turns 11 and 12, the two straight arms of the portion of turn 13, the two arms of the U-shaped portion 7, and the two electrical contact plates 5 are arranged substantially symmetrically with respect to a central plane that is perpendicular to the base element 3 of each movable contact 2.

In practice it has been found that the multipole current limiting circuit breaker according to the invention fully achieves the intended aim and objects, providing a significant series of advantages with respect to the known art.

As mentioned, each movable contact 2 is in fact connected to the actuation bar 1 in an exclusively elastic manner, by virtue of the spring 10 which, by being fixed both to the bar and to the movable contact, acts not only as a connecting element but also as a supporting element for said contact; furthermore, the spring 10, by virtue of its elastic nature and of its constructive structure, is capable of autonomously providing the movable contact with the freedoms of motion with respect to the bar and the corresponding fixed contact that in the known art are obtained by resorting to rigid supporting elements that entail the above listed problems and in any case require complicated systems for connection to the switchgear. In this manner, therefore, with respect to the known art, one obtains an improvement of the electrical and mechanical behavior of the circuit breaker, with a balanced distribution of the contact pressure between the contact surfaces of each pole, an improvement of general reliability and an extension of the useful lifetime of the poles of the circuit breaker. These effects are further increased and improved by the constructive structure, which is symmetrical to the central plane that is perpendicular to the base element of each movable contact and helps to equally distribute the loads among the electrical coupling surfaces of each pole.

Moreover, one should not ignore the fact that the structure of the contacts is simplified with respect to the known art and requires a reduced number of constructive components, with a consequent benefit from the point of view of costs and from the point of view of assembly and maintenance operations.

The circuit breaker thus conceived is susceptible of numerous modifications and variations, all of which are within the scope of the inventive concept; all the details may furthermore be replaced with other technically equivalent elements. In practice, the materials and the dimensions may be any according to the requirements and the state of the art.

What is claimed is:

1. A multipole current limiting circuit breaker comprising an insulating enclosure that contains:

for each pole, at least one fixed contact and at least one movable contact, which can be mutually coupled/uncoupled upon closure/opening of the circuit breaker;

actuation means, which provide the energy for moving said movable contacts and determines their coupling/uncoupling with the corresponding fixed contacts, said actuation means comprising a rotating actuation bar that is operatively coupled to the movable contacts of the poles;

characterized in that said movable contacts have a fork-shaped body having a base element that supports two suns provided with plates for electrical contact with corresponding coupling surfaces of the fixed contact, and in that said fork-like body is connected to the actuation bar by virtue of elastic means accommodated at least partially in a seat formed in the bar, said elastic means being anchored to said bar and being fixed to said base element so as to support the movable contact and facilitate a substantially uniform distribution of the pressure applied by the contact plates to said corresponding coupling surfaces of the fixed contact.

2. The current limiting circuit breaker according to claim 1, wherein said elastic means comprise a spring that is accommodated in said seat of the bar and is anchored thereto, a portion of said spring being fixed to the base element.

3. The current limiting circuit breaker according to claim 2, characterized in that said spring is a coiled flexural spring that is arranged in the seat with an axis that is substantially parallel to the rotation axis of the actuation bar.

4. The current limiting circuit breaker according to claim 3, characterized in that said portion fixed to the base element of the movable contacts is substantially U-shaped.

5. The current limiting circuit breaker according to claim 3, characterized in that said first and second series of turns, the two arms of said U-shaped portion, and the two electrical contact plates are arranged substantially symmetrically with respect to a central plane that is perpendicular to the base element of the movable contact.

6. The current limiting circuit breaker according to claim 2, characterized in that said portion fixed to the base element of the movable contacts is substantially U-shaped.

7. The current limiting circuit breaker according to claim 2, characterized in that said first and second series of turns, the two arms of said U-shaped portion, and the two electrical contact plates are arranged substantially symmetrically with respect to a central plane that is perpendicular to the base element of the movable contact.

8. The current limiting circuit breaker according to claim 1, characterized in that said portion fixed to the base element of the movable contacts is substantially U-shaped.

9. The current limiting circuit breaker according to claim 1, characterized in that said first and second series of turns, the two arms of said U-shaped portion, and the two electrical contact plates are arranged substantially symmetrically with respect to a central plane that is perpendicular to the base element of the movable contact.

10. A multipole current limiting circuit breaker comprising an insulating enclosure, the breaker comprising:

for each pole, at least one fixed contact and at least one movable contact, which can be mutually coupled/uncoupled upon closure/opening of the circuit breaker;

actuation means, which provide the energy for moving said movable contacts and determines their coupling/uncoupling with the corresponding fixed contacts, said actuation means comprising rotating actuation bar that is operatively coupled to the movable contacts of the poles;

wherein said movable contacts have a fork-shaped body having a base element that supports two arms provided with plates for electrical contact with corresponding coupling surfaces of the fixed contact, and in that said fork-like body is connected to the actuation bar by virtue of elastic means accommodated at least partially in a seat formed in the bar, said elastic means being anchored to said bar and being fixed to said base element so as to support the movable contact and facilitate a substantially uniform distribution of the pressure applied by the contact plates to said corresponding coupling surfaces of the fixed contact, said elastic means comprising a spring that is accommodated in said seat of the bar and is anchored thereto, a portion of said spring being fixed to the base element, said spring comprising a coiled flexural spring that is arranged in the seat with an axis that is substantially parallel to the rotation axis of the actuation bar, wherein said coiled spring comprises a first series and a second series of helical turns arranged coaxially to each other in said seat and substantially parallel to the rotation axis of the actuation bar, said first and second series of turns having a free end that is inserted in a corresponding recess formed in the seat and being mutually connected, in a substantially central region, by a seat and being mutually connected, in a substantially central region, by a portion of a turn that lies transversely to the axis of the spring and forms said portion that is fixed to the base element.

11. The current limiting circuit breaker according to claim 10, characterized in that the free end of said first and second series of helical turns is arranged substantially parallel to the axis of the turns and engages a corresponding recess formed in the walls of said seat.

12. The current limiting circuit breaker according to claim 11, characterized in that said portion fixed to the base element of the movable contacts is substantially U-shaped.

13. The current limiting circuit breaker according to claim 11, characterized in that said first and second series of turns, the two arms of said U-shaped portion, and the two electrical contact plates are arranged substantially symmetrically with respect to a central plane that is perpendicular to the base element of the movable contact.

14. The current limiting circuit breaker according to claim 10, characterized in that said portion of turn that lies transversely to the axis of the spring comprises two mutually parallel arms, each connected to a corresponding series of turns and directed along a path that connects the bar to a movable contact, said arms being mutually connected by said portion fixed to the base element of the movable contact.

15. The current limiting circuit breaker according to claim 14, characterized in that said portion fixed to the base element of the movable contacts is substantially U-shaped.

16. The current limiting circuit breaker according to claim 14, characterized in that said first and second series of turns, the two arms of said U-shaped portion, and the two electrical contact plates are arranged substantially symmetrically with respect to a central plane that is perpendicular to the base element of the movable contact.

17. The current limiting circuit breaker according to claim 10, characterized in that said U-shaped portion is arranged so as to rest at least partially against a face of the base element and is fixed thereto by virtue of a fixing element.

18. The current limiting circuit breaker according to claim 17, characterized in that said fixing element comprises a cylindrical head from which a cylindrical stem protrudes, said stem having a smaller diameter than said head, the fixing element being rigidly fixed to the body of the movable contact with the stem that is surrounded by the arms of the U-shaped portion and passes through the base element and with the head that presses the U-shaped portion against a face of said base element.

19. The current limiting circuit breaker according to claim 10, characterized in that said portion fixed to the base element of the movable contacts is substantially U-shaped.

20. The current limiting circuit breaker according to claim 10, characterized in that said first and second series of turns, the two arms of said U-shaped portion, and the two electrical contact plates are arranged substantially symmetrically with respect to a central plane that is perpendicular to the base element of the movable contact.

* * * * *